US006095173A

United States Patent [19]

Perry

[11] Patent Number: 6,095,173

[45] Date of Patent: Aug. 1, 2000

[54] GAS PUMP FILL AUTOMATIC SHUT-OFF ADAPTOR

[76] Inventor: Anthony G. Perry, 3941-13 Cornerwood La., Charlotte, N.C. 28211

[21] Appl. No.: 09/123,894

[22] Filed: Jul. 28, 1998

[51] Int. Cl.[7] ..... B65B 3/04; G05G 5/06

[52] U.S. Cl. ..... 137/15; 74/526; 251/90; 251/111; 141/392

[58] Field of Search ..... 251/90, 111; 74/526; 248/215, 221.12, 222.41, 225.21, 227.1; 141/208, 209, 390, 391, 392; 137/15

[56] References Cited

U.S. PATENT DOCUMENTS

| | | | |
|---|---|---|---|
| 4,095,629 | 6/1978 | Jordan | 251/90 |
| 4,175,595 | 11/1979 | Noe | 251/90 |
| 4,200,128 | 4/1980 | Pokrzywa | 251/90 |
| 4,201,253 | 5/1980 | Maloney | 251/90 |
| 4,210,181 | 7/1980 | Clevenger | 141/392 |
| 4,245,682 | 1/1981 | Agnew, Sr. | 251/90 |
| 4,275,776 | 6/1981 | Rehkopf | 251/90 |
| 4,278,116 | 7/1981 | Opp | 251/90 |
| 4,287,736 | 9/1981 | Hadgis | 141/392 |
| 4,334,560 | 6/1982 | Lockwood | 141/392 |
| 4,337,917 | 7/1982 | Tesack et al. | 251/90 |
| 4,683,923 | 8/1987 | Harris | 251/90 |
| 4,690,182 | 9/1987 | Knaus | 141/392 |
| 4,722,375 | 2/1988 | Fox | 251/90 |
| 4,846,447 | 7/1989 | Hanna | 251/90 |
| 5,118,074 | 6/1992 | Weissman | 251/90 |
| 5,517,732 | 5/1996 | Crear | 141/392 |

*Primary Examiner*—George L. Walton
*Attorney, Agent, or Firm*—McGlew and Tuttle, P.C.

[57] ABSTRACT

An element is provided which includes a control section connection end and a setting position end for enabling a setting of the filling mechanism, with automatic shut-off. The setting end includes a retaining portion. The retaining portion acts to retain the element associated with a gasoline filling mechanism, even after gasoline filling shut-off. The element includes a hole or opening. The opening formed in the device adaptor element receives a connection element. This arrangement is particularly useful for supporting keys or other functional devices such as a bell which may be connected with the automatic gas fill adaptor element device.

11 Claims, 8 Drawing Sheets

16'

16"

16'''

15'

15"

15'''

GAS PUMP FILL AUTOMATIC SHUT-OFF ADAPTOR

FIELD OF THE INVENTION

The invention relates to an adaptor for gasoline pump filling mechanisms and more particularly to an adaptor for an automatic shut-off device associated with a gasoline pump filling mechanism.

BACKGROUND OF THE INVENTION

Gasoline pumps are normally provided with a filling device having an automatic shut-off feature. This device typically includes a setting element which may be positioned to set a fill rate and wherein when the gas tank being filled reaches a level, a force is applied to the setting element which disengages it shutting off the filling mechanism.

Filling stations occasionally disable these fill setting devices. This leads to the need to grasp the filling handle of the filling mechanism the entire time the gas is flowing into the gas tank.

SUMMARY AND OBJECTS OF THE INVENTION

It is an object of the invention to provide a convenient adaptor which may be used to set a filling mechanism and which will allow the control element of the filling mechanism to be released from a filling position automatically even with a disabled automatic shut-off setting mechanism.

According to the invention, an element is provided which includes a control section connection end and a setting position end for enabling a setting of the filling mechanism, with automatic shut-off.

According to a preferred embodiment of the invention, the setting end includes a retaining portion. The retaining portion acts to retain the element associated with a gasoline filling mechanism, even after gasoline filling shut-off.

According to a further feature of the invention, the element includes a hole or opening. The opening formed in the device adaptor element receives a connection element. This arrangement is particularly useful for supporting keys, gas cap, or other functional devices such as a bell which may be associated with the automatic gas fill adaptor element device which provides an automatic shut-off on impact. In this way, when the element is moved, upon automatic shut-off of the filling mechanism, the connector element also moves such that the bell makes an audible sound, signaling the completion of the filling process.

Preferably the setting end retaining portion is in the form of a hook. This is especially advantageous as filling mechanisms typically are provided with a protective bar section on the filling mechanism handle. The adaptor element cooperates with the automatic shut-off feature of the filling mechanism and the control element of the filling mechanism moves into a shut-off state. The retaining means, in the form of a hook or catch, will engage with the protective bar section. This is an advantageous feature as it prevents the adaptor element from falling to the ground upon completion of the filling process.

The retaining portion may include a well defined hook portion extending in a lateral direction of the adaptor element as well as a longitudinal direction of the adaptor element. The retaining portion may also have a very short hook structure in the portion extending in the longitudinal direction of the retaining element. The retaining portion extending in a lateral direction.

The provision of a short or a longer hook is proved advantageous with regard to filing mechanisms which include protective bars which have side walls. However, some filling elements have protective bars which have no side walls and are generally plainer. In this case, a retaining element which only extends laterally has proven to be useful. The retaining element may also be formed to be semi-rigid or even elastic and/or may have a surface which is rubberized providing better frictional engagement if the protective bar were retaining the adaptor element to the filling mechanism, before shutoff and after shut-off (after completion of the filling process). If semi-rigid or elastic material is used for the adaptor element, the adaptor can be flexed to fit in place effectively decreasing its length. When set in functioning position with the flexion force removed, the adaptor will rebound to its full or near full effective length to wedge the setting element into filling position. After automatic shut off of the filling mechanism, the wedge force from the tendency of the adaptor to resume its resting length will hold the adaptor, connecting element and supported functional devices in place within the fill mechanism. The filling mechanism protective bar has a greater dimension (greater width) than a lower section. The upper section is the filling mechanism control element connection side and the lower section is fill level setting side. The lower section includes the retaining portion. At a lower side of the upper section, near an interface with the lower section, a hole or opening is provided for receiving a connection element. The difference in outer dimension (width) allows the connection element to hang downwardly from the adaptor element. This is particularly advantageous when the adaptor element is positioned in its operative position (i.e. setting the rate of fill of the filling mechanism). It will hang on the connection element outwardly of the filling mechanism (particularly outwardly of the filling mechanism protective bar).

The device will still function if the upper section and lower section are provided with the same width. The difference in width may also be a small difference in width. Additionally, the top of the upper section may have an uppermost width such that it still can engage the control element of the filling mechanism and the upper section may also have a central region or connection region which extends outwardly (in the manner of a cantilever) allowing keys or connected elements to hang outwardly of the filling mechanism.

The hole in the adaptor element is preferably the size, which is just a bit larger than the dimension of the connector element. This can serve to hold the plane of the connector element relatively perpendicular to the adaptor element. This allows the connector element to swing or pivot within the hole and should facilitate a positioning of the elements attached to the connector element and also facilitates the movement of the adaptor element as it is disengaged from the setting position upon shut-off of the filing mechanism.

The connecting element may be a simple key chain ring with a spiral loop to form the ring, allowing keys to be added. Other types of connector elements may be used.

The adaptor element may be made of a rigid plastic but it may also be made of a semirigid or even a flexible plastic. Upper and lower ends may be provided as interface ends with high friction surfaces (i.e. rubberized, tacky, or other high friction surfaces) positioning of the adaptor element in a fill setting position.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIGS. 2C–2G are cutaway views showing retaining structure of still other embodiments of the invention;

DESCRIPTION OF THE PREFERRED EMBODIMENTS

Figure 1B:
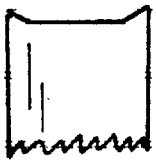
FIG. 1B is a front cutaway view of an interface end according to another embodiment of the invention.
Figure 1C:
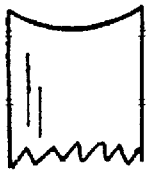
FIG. 1C is a front cutaway view of an interface end according to another embodiment of the invention.
Figure 1D:
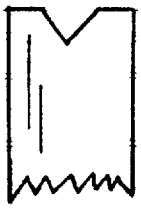
FIG. 1D is a front cutaway view of an interface end according to another embodiment of the invention.

Referring to the drawings in particular, the invention comprises a fill mechanism adaptor generally designated 10. The adaptor 10 includes a lower section 12 with a lower interface end 13 and an upper section 14 with an upper interface end 15. The upper interface end 15 is provided to engage a control element or trigger of a fill mechanism. The upper interface ends 15', 15" and 15" of FIG. 1B, 1C and 1D may also be used. Another shape as in FIG. 9 may also be used. The lower interface 13 is provided to engage a setting surface of a setting side of an automatic shut-off device for a filing mechanism.

The lower end 12 also includes a retaining portion 16. According to a preferred embodiment of the invention, the retaining portion 16 is in the shape of a hook, namely it includes a laterally extending portion and a longitudinally extending portion.

In a region adjacent to an interface between the upper section 14 and the lower section 12, an opening or hole 18 is provided in the adaptor element 10. The hole or opening is provided for the attachment of a connection element 20.

Figure 1A:
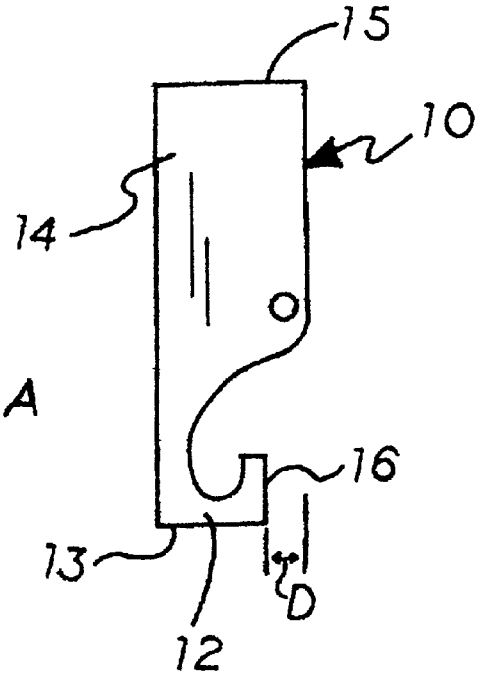
FIG. 1A is a front view of a fill mechanism adaptor element with an interface end according to the invention.
Figure 2A:
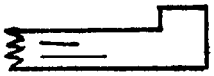
FIG. 2A is a front cutaway view showing a retaining portion according to an alternative embodiment of the invention.
Figure 2B:
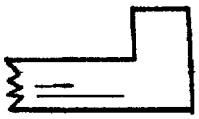
FIG. 2B is a front cutaway view showing a retaining structure according to still another embodiment of the invention.
Figure 2C:
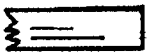
Figure 2D:
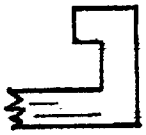
Figure 2G:
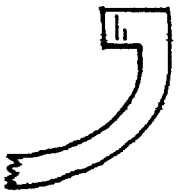
Figure 3:
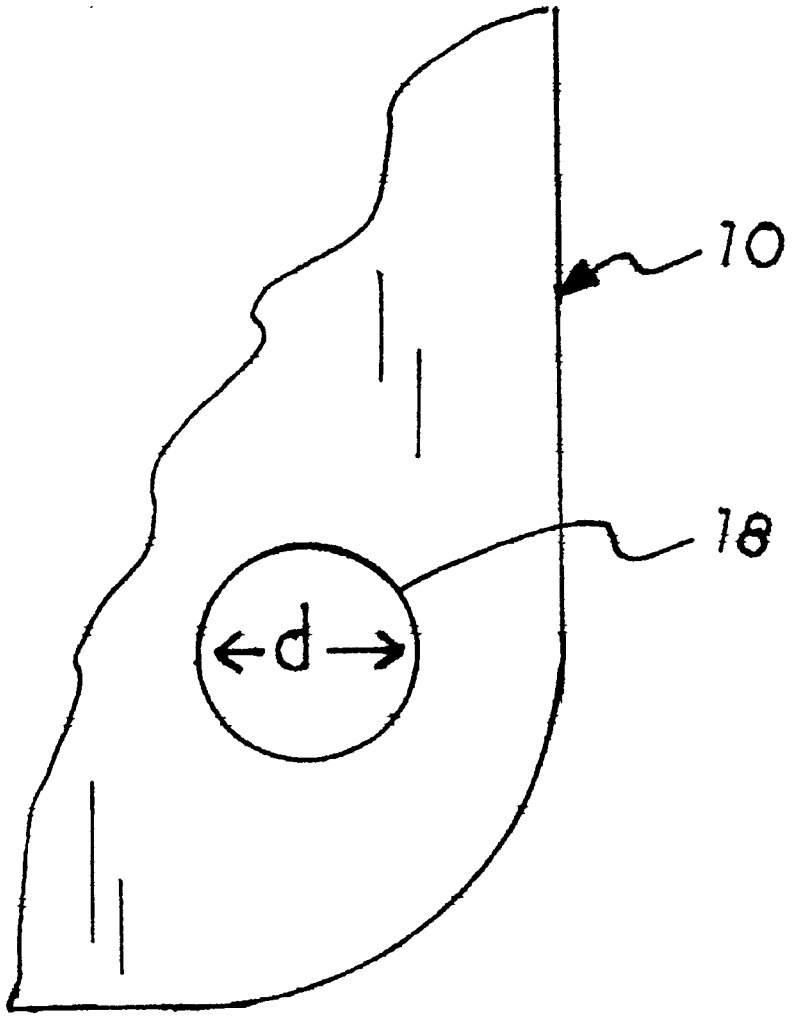
FIG. 3 is a cutaway view showing a connection region of an upper portion of the adaptor element.
Figure 4:
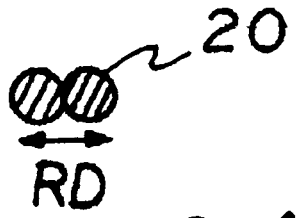
FIG. 4 is a cross-sectional view showing a diameter of a connection element.
Figure 5:
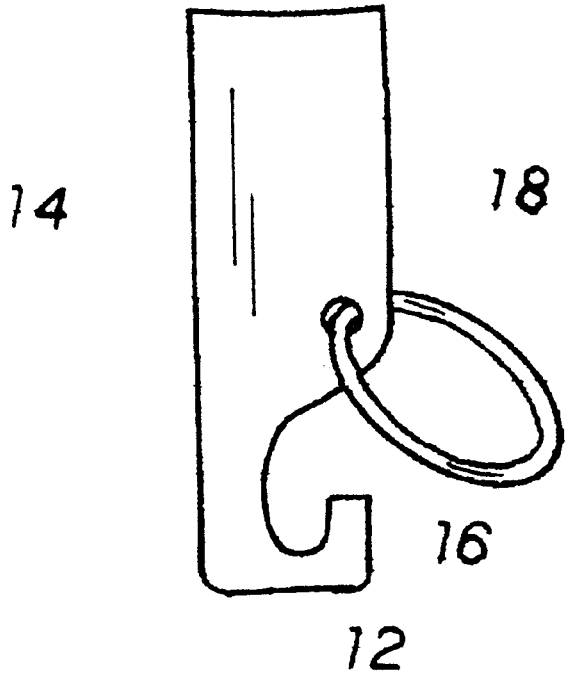
FIG. 5 is a front view of the fill mechanism adaptor with attached connection element.
Figure 6:
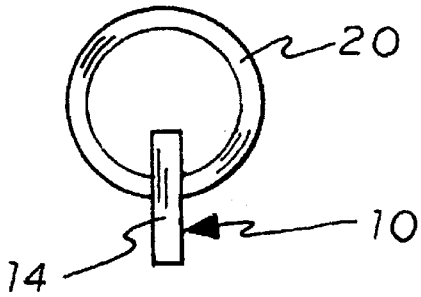
FIG. 6 is a top view of the fill mechanism adaptor and attached connection ring.
Figure 7:
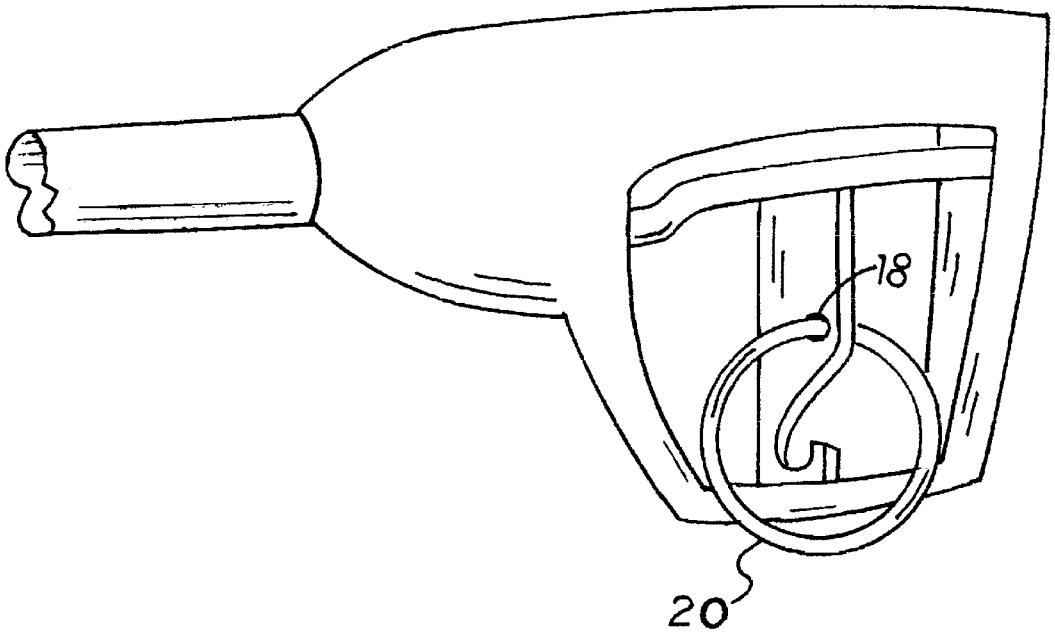
FIG. 7 is a side view of a fill mechanism with fill mechanism adaptor in a fill setting position.
Figure 8:
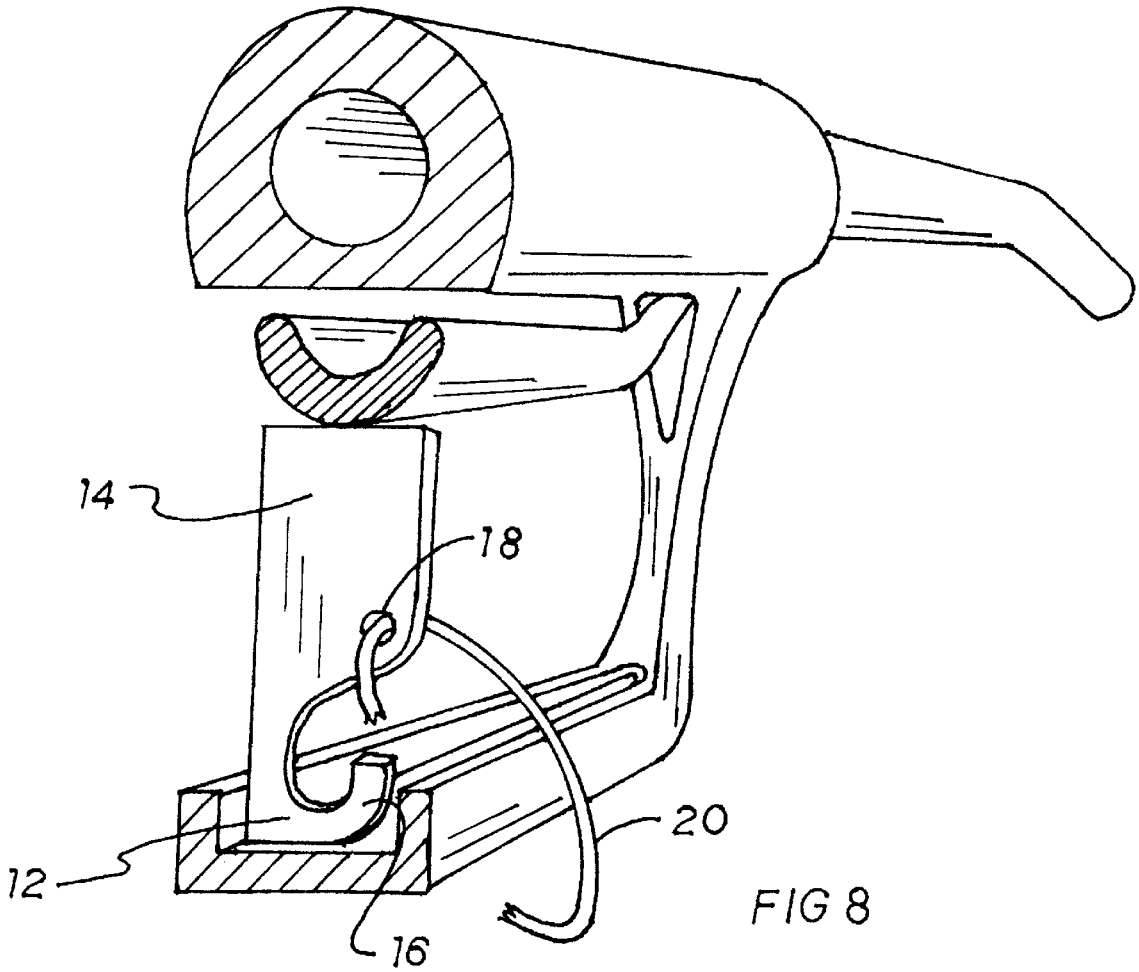
FIG. 8 is a rear-side partially cutaway perspective view of a fill mechanism adaptor according to another embodiment of the invention.

FIG. 2*a* shows an alternative embodiment of the retaining portion 16. In the embodiment of FIG. 2*a,* a retaining portion 16' is used which includes only a very short longitudinally extending portion. The embodiment of FIG. 2*b* provides a retaining portion 16". The retaining element 16" has a rather long longitudinally extending portion. This is particularly useful when using the adaptor with filling mechanisms that have protective bar sections with sidewalls. The embodiment of FIG. 2*c* provides a retaining region 16" wherein there is no longitudinally extending portion. This is particularly useful with filing mechanisms having protective bars or trigger guard (i.e., the lower member) which are flat or plainer (i.e. there is no sidewall). Particularly for the embodiment of FIG. 2*c,* the retaining portion is coated with a high friction material or is rubberized. This enhances the retaining function as described further below. Other retaining regions 16 are shown in FIG. 2D, 2G FIG. 3 shows a cutaway view of the upper portion of adaptor element 10. A hole 18 is preferably provided near to an interface between the upper region 14 and the lower region 12. Hole 18 has a dimension d which is preferably just a bit larger than the dimension RD of the connection element 20. As can be seen in FIG. 1, the lateral position of the hole 18 is preferably outwardly of the lateral extent of the retaining portion 12. That is, there is a distance D between the outward extension of retaining portion 16 and the location of hole 18. This provides an overhang which facilitates the positioning or disposal of keys or other elements attached to connection element 20. As shown in FIG. 8, an alternative embodiment of the adaptor 10 provides little or no overhang as the hole 18 is positioned generally above the outward extent of the retaining portion 16. In this embodiment the upper section 14 has the same lateral dimension as the lower section 12 (or nearly the same).

Figure 9:
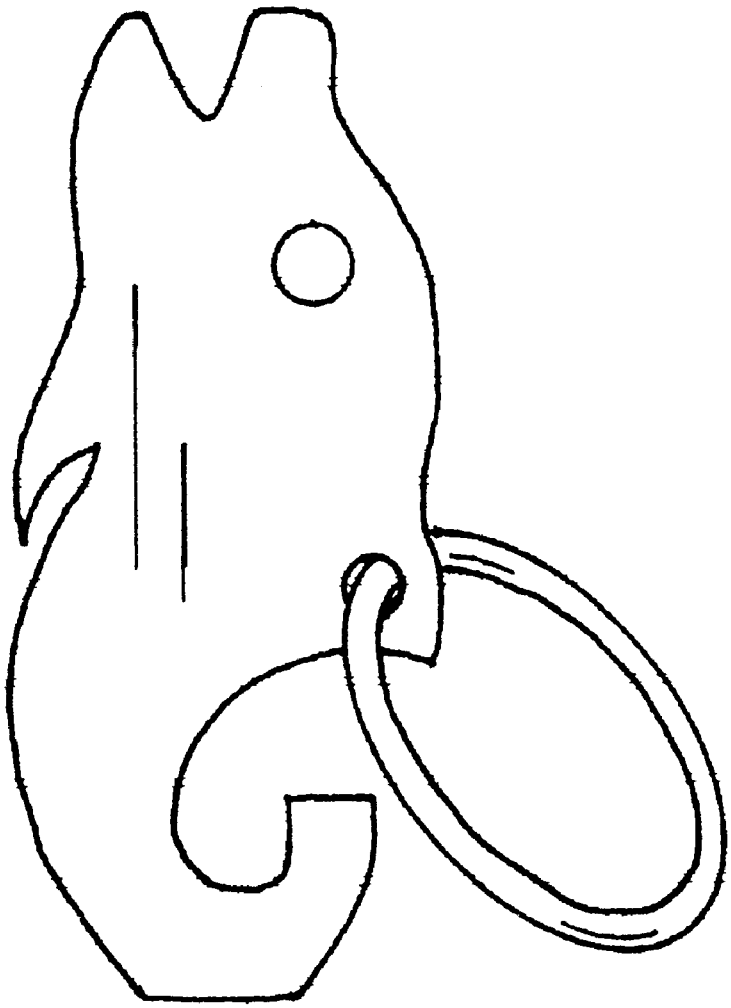
FIG. 9 is a front view of a fill mechanism adaptor according to another embodiment of the invention.

The embodiment of FIG. 9 provides three different lateral dimensions, namely a dimension of an upper portion of the adaptor 10 which includes the upper interface 15, a dimension of the lower portion of the adaptor which includes interface 13 as well as retaining portion 16 and an intermediate portion with a lateral dimension which is greater than the other lateral dimensions. This provides a significant overhang whereby the keys or other elements connected to the connection element are retained outwardly of the adaptor element and the filling mechanism during use. This overhang position also provides a significant moment arm whereby when the adaptor element is released upon shut-off, the weight of the connection element and attached elements (such as keys or bell or the like) result in a force which pulls the adaptor element downwardly at the location of hole 18 allowing the lower end to pivot such that the retaining element can engage the protective bar of the filling mechanism.

Figure 10:
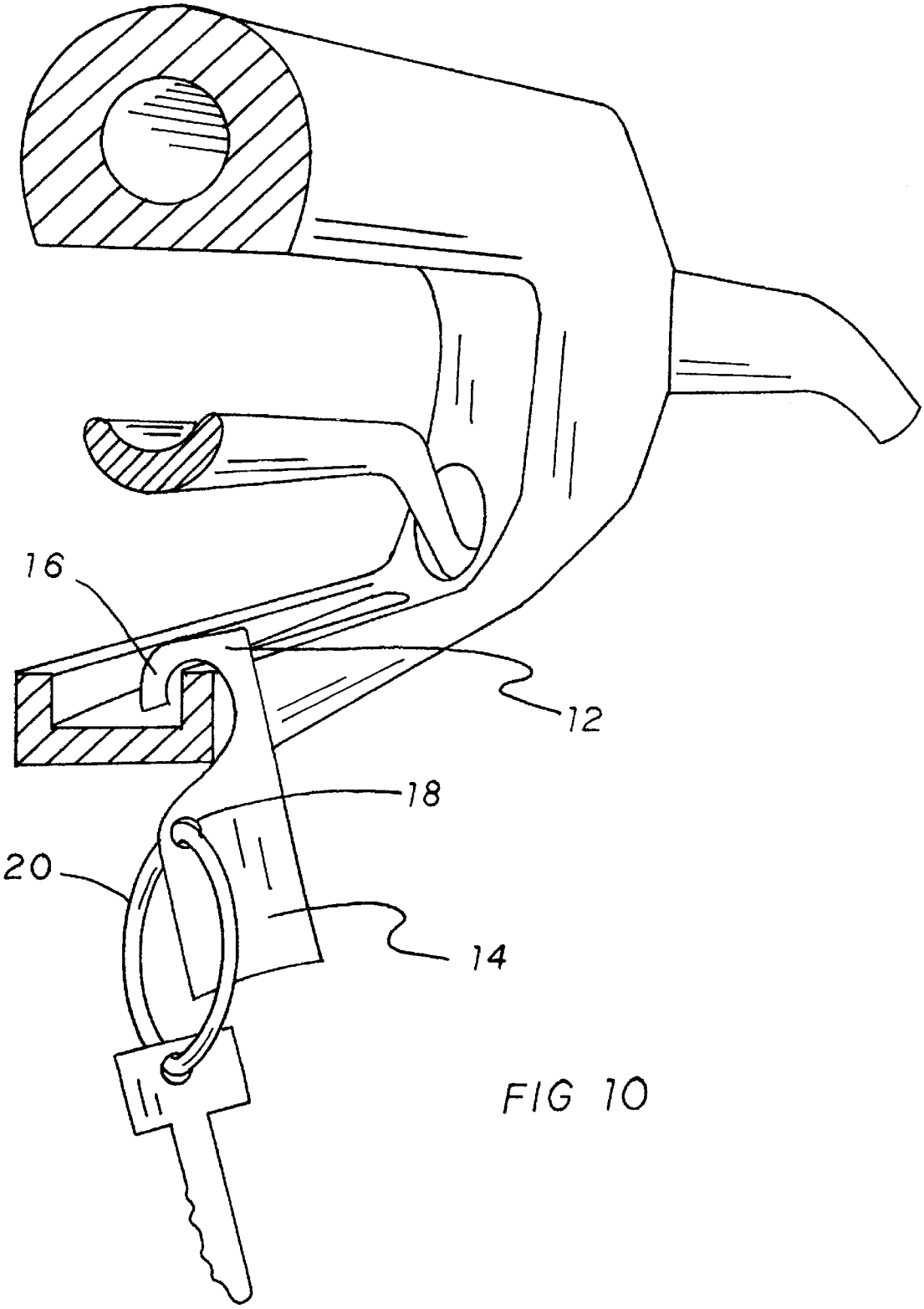
FIG. 10 is a view similar to FIG. 8 showing the fill mechanism adapter after shut off of the fill mechanism.

FIG. 10 shows that with the weight of the attached keys and moment arm, a pivoting can result. Specifically, when the adapter element is released upon shut-off, the weight of the connection element and the attached element (e.g. keys) result in a force which pulls on the adapter element.

While specific embodiments of the invention have been shown and described in detail to illustrate the application of the principles of the invention, it will be understood that the invention may be embodied otherwise without departing from such principles.

What is claimed is:

1. A fuel filling mechanism adaptor for use with a filling mechanism having an actuating trigger and a trigger guard, the adaptor comprising: an adaptor element with an upper end with an upper surface having an upper end control element connection interface; a lower end with a lower surface having a lower end connection interface, a retaining element disposed between said upper surface and said lower surface, said retaining element including a connection hook whereby said adaptor element may be disposed hanging by said hook and whereby said adaptor may be positioned between said actuating trigger and said trigger guard to position said actuating trigger for activating the filling mechanism and whereby upon shutoff of the filling mechanism, the actuating trigger moves allowing the adaptor element to fall such that the retaining element hangs onto the trigger guard via said connection hook.

2. An adaptor according to claim 1, further comprising a connector element connected to the adaptor element.

3. An adaptor according to claim 2, wherein the connector element is a key ring.

4. The fuel filling mechanism adaptor according to claim 1, wherein the adaptor has a shape to provide a recognizable form.

5. A method comprising the steps of:

providing a fuel filling mechanism with a nozzle and fuel hose and a trigger and trigger guard;

providing an adaptor element with a trigger connection interface and a trigger guard connection interface, said adaptor having a retaining element between said trigger interface and said trigger guard interface;

attaching a connector element to the adaptor element;

connecting an object to the connector element;

positioning the adaptor element with the upper interface in contact with the trigger and with a lower interface in contact with the trigger guard in a filling position of the trigger to actuate the filling mechanism;

subsequently to said step of positioning, upon movement of the trigger at the completion of filling, retaining the adaptor to the trigger guard of the filling mechanism in a hanging position with the retaining element and with the upper interface extending away from said trigger guard and away from said trigger, after the adaptor is allowed to fall out of the position with the upper interface in contact with the trigger and with a lower interface in contact with the trigger guard.

6. The method according to claim 5, further comprising the step of:

moving said adaptor from the filling position to the hanging position upon shutoff of the filling mechanism by moving the trigger; and removing the adaptor from the filling mechanism trigger guard upon completing fuel filling.

7. The method according to claim 6, wherein said step of moving includes applying a force, applied by the weight of the object through said connector, to said adaptor to pivot said adaptor from the filling position to the hanging position.

8. A method for operating a fuel filling mechanism having a nozzle and fuel hose and a trigger and trigger guard with an adaptor element having an adaptor element with a trigger interface and a trigger guard interface, said adaptor having a retaining element, the method comprising the steps of:

attaching a connector element to the adaptor element;

connecting an object to the connector element;

positioning the adaptor element with the trigger interface in contact with the trigger and with the trigger guard interface in contact with the trigger guard, in a filling position of the trigger, to actuate the filling mechanism;

retaining the adaptor to the trigger guard of the filling mechanism in a hanging position with the retaining element and with the upper interface extending away from said trigger guard and away from said trigger;

moving said adaptor from the filling position to the hanging position upon shut-off of the filling mechanism by moving the trigger; and removing the adaptor from the filling mechanism trigger guard upon completing fuel filling.

9. The method according to claim 8, further comprising the step of:

moving said adaptr from the filling position to the hanging position upon shut-off of the filling mechanism by moving the trigger; and removing the adaptor from the filling mechanism trigger guard upon completing fuel filling.

10. The method according to claim 8, wherein said step of moving includes applying a force, applied by the weight of the object through said connector, to said adaptor to pivot said adaptor from the filling position to the hanging position.

11. The method according to claim 8, wherein the adaptor is shaped to provide a recognizable form.

* * * * *